United States Patent [19]

Takahashi et al.

[11] Patent Number: 4,523,433

[45] Date of Patent: Jun. 18, 1985

[54] COLD STORAGE BODY

[75] Inventors: Masahiro Takahashi, Shizuoka; Toshio Hagiwara, Tokyo; Takao Nishizaki, Tokyo; Kinya Niizeki, Tokyo, all of Japan

[73] Assignee: Nippon Light Metal Co., Ltd., Tokyo, Japan

[21] Appl. No.: 620,156

[22] Filed: Jun. 13, 1984

Related U.S. Application Data

[63] Continuation of Ser. No. 371,060, Apr. 23, 1982, abandoned.

[30] Foreign Application Priority Data

May 25, 1981 [JP] Japan ..... 56-78864

[51] Int. Cl.[3] ..... B65B 63/08

[52] U.S. Cl. ..... 62/60; 62/530; 220/66

[58] Field of Search ..... 62/294, 371, 457, 529, 62/530, 60; 220/66, 77

[56] References Cited

U.S. PATENT DOCUMENTS

| | | | |
|---|---|---|---|
| 2,244,341 | 6/1941 | Maclean | 62/294 X |
| 3,726,106 | 4/1973 | Jaeger | 62/294 |
| 3,730,383 | 5/1973 | Dunn et al. | 220/66 |

FOREIGN PATENT DOCUMENTS

| | | | |
|---|---|---|---|
| 19855/29 | of 1929 | Australia | 62/530 |
| 166369 | 12/1955 | Australia | 62/530 |
| 892458 | 8/1954 | Fed. Rep. of Germany | 62/530 |
| 401635 | 9/1909 | France | 62/530 |
| 844800 | 8/1939 | France | 62/530 |

*Primary Examiner*—Lloyd L. King

*Attorney, Agent, or Firm*—McAulay, Fields, Fisher, Goldstein & Nissen

[57] ABSTRACT

A cold storage body that comprises a hermetically sealed vessel made of aluminum alloy in which a cold storage medium in an appropriate amount is enclosed with a space remaining within the vessel filled with a compressed inert gas at an appropriate pressure. The vessel may comprise a can type trunk portion of a thin aluminum sheet having an open end with a cover member closing the open end of the trunk member. The thus formed cold storage body has sufficient strength regardless of temperature variation for cooling the cold storage body as well as a long durability and a high corrosion resisting property.

18 Claims, 6 Drawing Figures

COLD STORAGE BODY

This is a continuation of application Ser. No. 371,060 filed Apr. 23, 1982, now abandoned.

BACKGROUND OF THE INVENTION

The present invention relates to a cold storage body for cooling foods and pharmaceuticals and the like in a refrigerator or a refrigerator car in which no thermodynamically operated refrigerating machine is provided.

Heretofore, as a cold storage body of the kind described above, a cooling medium rendered to be in the state of ice or dry ice by removing heat from the cooling medium which is kept in the liquid or gaseous state at the normal temperature is used in the loose state or in bulk, or two kinds of substances are used which are stored in separate places from each other, and they are mixed with each other for cooling by virtue of the chemical reaction thereof so as to generate cold.

One well known cold storage body comprises in general a viscous cold storage medium hermetically sealed in a soft or rigid plastic vessel. Such a cold storage body has the following difficulties due to the nature of the plastic vessel.

(a) Since the thermal conductivity of the plastic vessel is low, a long time is required for freezing the cold storage medium contained in the plastic vessel, and the cooling effect obtained by the cold storage medium is rather slow. Therefore a, large number of cold storage bodies must be prepared in order to insure positive cooling of the goods, because the time required for freezing the cold storage bodies is too long.

(b) The soft or thin plastic vessels are liable to be damaged or broken and the durability of such vessles is low. Further, as a common difficulty inherent in the vessels made of plastic material, climate resisting property or temperature and humidity resisting property and light or radiation resistance of such vessels are low and they are prone to aging and change in quality so that their useful life is short.

(c) Since the plastic material shrinks or becomes brittle with cold, vessels made of plastic material can not be used in the low temperature range such as −15° C.−−25° C. Further, it has disadvantages in achieving rapid freezing of the cold storage medium therein at a low temperature.

(d) A plastic vessel is liable to be soiled and difficulties arise in washing and sterilization with hot water, because the vessel is softened by hot water.

(e) With a soft plastic vessel, the outer shape of the vessel easily varies and is unstable even though a cold storage medium in the gelled state is used, and, therefore, use thereof is not convenient.

SUMMARY OF THE INVENTION

The present invention aims at avoiding the above described difficulties inherent in the prior art cold storage bodies.

The object of the present invention is, therefore, to provide a novel and useful cold storage body having a vessel made of aluminum which can be manufactured at a low cost so that fresh foods, frozen foods and the like can be efficiently and conveniently stored, transported and delivered with the foods being maintained in the highest quality thereby permitting energy requirements to be reduced greatly while effective quality control is achieved.

Further, the present invention provides a novel and useful cold storage body having a vessel of aluminum in which liquid cold storage medium of low viscosity is enclosed and hermetically sealed by means of a cover which is curled together with the peripheral edge of the vessel, the space in the vessel not filled with the cold storage medium being filled with an inert gas such as $N_2$, $CO_2$ or a mixture thereof pressurized to an appropriate pressure for obtaining corrosion resisting property.

The cold storage body of the present invention comprises a hermetically sealed vessel made of a thin metallic material in which cold storage medium in an appropriate amount is enclosed with a space remaining within the vessel filled with a compressed gas at an appropriate pressure, the cold storage medium comprising a base fluid to which additional components are added so as to regulate the melting point and the viscosity of the cold storage medium.

The vessel is preferably formed of a thin sheet of aluminum alloy.

The cold storage medium preferably comprises water as its base fluid to which the additional regulating components are added.

The vessel may comprise a cylindrical trunk member with its one end closed and the other end opened and a cover member with its peripheral edge being curled together with the peripheral edge of the open end of the cylindrical trunk member so as to achieve the hermetic sealing of the vessel.

Alternatively, the vessel may comprise an extruded profiled hollow trunk member of aluminum alloy and a pair of cover members each hermetically sealed to the respective end of the trunk member.

Further, the wall of the vessel may be formed with a plurality of parallel ridges so as to enhance the strength of the vessel while giving it improved cold transmitting capacity.

The extruded hollow trunk member is preferably provided with a plurality of parallel reinforcing ribs integrally formed in the hollow space thereof so as to enhance the strength of the vessel while giving it improved cold transmitting properties.

The compressed gas preferably comprises an inert gas such as $N_2$, $CO_2$ and the like so as to give corrosion resistance property to the cold storage body.

DETAILED DESCRIPTION OF THE PREFERRED EMBODIMENT

With reference to FIGS. 1–4 showing the first embodiment of the present invention, the vessel is made of a thin aluminum sheet and comprises a cylindrical trunk member 1 with one end closed and the other end opened, the peripheral edge of which is sealingly curled together with the peripheral edge of a cover member 2.

The cold storage medium 3 enclosed within the vessel comprises water as its base liquid and additional components for regulating the melting point and the viscosity of the base liquid.

The space 4 within the vessel which is not filled with the cold storage medium 3 is filled with a pressurized inert gas such as $N_2$, $CO_2$ and a mixture thereof and the like so as to enhance the strength of the vessel and prevent the wall of the vessel from being deformed.

Figure 1:
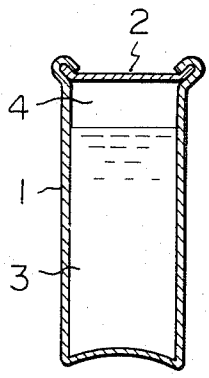
FIG. 1 is a longitudinal sectional view showing a preferred embodiment of the cold storage body formed of a thin aluminum vessel.
Figure 2:
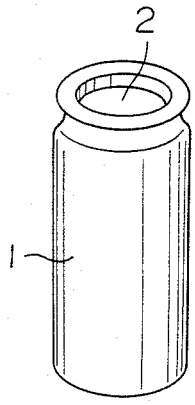
FIG. 2 is a perspective view of FIG. 1.
Figure 3:
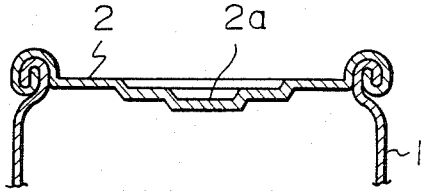
FIG. 3 is a fragmentary sectional view showing the curled sealing portion of the vessel of FIG. 1.
Figure 4:
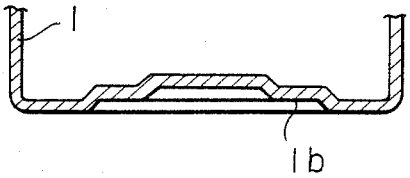
FIG. 4 is a fragmentary sectional view showing the configuration of the bottom portion of the vessel of FIG. 1.
Figure 5:
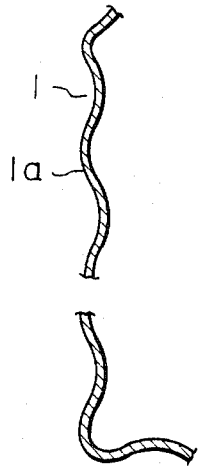
FIG. 5 is a fragmentary sectional view showing the configuration of the peripheral wall of the vessel of FIG. 1.

The thickness of the wall of the aluminum trunk member 1 is equal to or less than 2 mm and, as shown in FIGS. 3–5, parallel ridges or corrugations 1*a* and recessed deformation 1*b* are formed in the trunk member 1, while recessed deformation 2*a* is formed in the cover member 2, thereby permitting the strength of the vessel to be increased and the cold transmitting property to be improved.

It is clear that the vessel of the present invention has a superior thermal conductivity in comparison with a prior art vessel made of plastic material, so that the cold storage medium 3 can be frozen in far shorter time than that required for freezing the cold storage body of the prior art, and also the cooling effect of the cold storage body of the present invention is move rapid by comparison with that of the prior art cold storage body.

Since the strength of the vessel of the present invention at a low temperature is higher in comparison with that of a prior art cold storage body made of plastic, the cold storage body of the present invention can conveniently and effectively refrigerate frozen foods and the like at a low temperature in the range of −15° C. and −25° C. Further, the vessel of the present invention is far superior in its corrosion and climate resistance in comparison with a prior art plastic vessel so that a high durability is insured by the vessel of the present invention.

Further, since the vessel is made of aluminum, it will not be soiled, while it can be kept clean by hot water washing and mechanical washing and the like.

As described previously, the cold storage medium 3 is a liquid storage medium of a low viscosity having water as its base liquid, and its melting point can be regulated by adjusting the contents, blending and amount of the additional components, so that the melting point can be tailor-made to meet use requirements. For example, melting point may be selected as follows according to the end use.

0° C.—vegetables, daily delivered foods, noodles
−5° C.—fresh fish, meat
−15° C.—frozen foods
−25° C.—ices The amount of cold storage medium 3 used must be so selected with respect to the volume of the space 4 that the volume of the space 4 be made equal to or more than 15% of the total volume of the vessel so that no deformation or breakage of the aluminum vessel can occur by the increase in volume of the liquid cold storage medium 3 as it is being frozen.

The inert gas enclosed in the vessel may be any kind inert gas insofar as it will not cause a change in quality or corrosion of the aluminum vessel or the coating thereon as well as a change in quality of the cold storage medium; and, practically, $N_2$, $CO_2$ or mixture thereof is preferably used, because they are easily and economically available without requiring any expensive processing apparatus.

By enclosing the inert gas in the space 4 after removing air in the vessel and the cold storage medium, any additional regulating components in the cold storage medium will not change in quality even though they are of an oxidizable nature, so that the cooling effect of the cold storage body of the present invention can be maintained for a long period of time. Further, the oxidized inner surface of the aluminum vessel has a corrosion preventing effect thereon, thereby positively reducing the danger of causing corrosion even though the coating on the inner surface of the vessel has deficiencies such as pin-holes.

Several test results of the cold storage body of the present invention will be given below.

Test I

After the liquid cold storage medium was adjusted to a viscosity of 4CP and a melting point of −5° C. it was subjected to deairing by using a dearetor. The temperature of the cold storage medium was adjusted to 20° C. and the medium was placed in a carbonator in which it was mixed with agitated $CO_2$ gas having a gage pressure of 2 Kg/cm$^2$, and then it was transferred to a filling machine in which it was poured in the cylindrical trunk member 1 of the aluminum vessel of 250 ml in a predetermined amount. The peripheral edge of the cover member 2 was sealingly curled together with the peripheral edge of the open end of the trunk member 1 while $CO_2$ gas was being blown into the trunk member 1.

The cold storage body aluminum vessel thus produced was not deformed by a usual external force even though the trunk member was pressed by the fingers of the investigator, and it was provided in feasibility tests that the above described cold storage body had sufficient strength.

Test II

The liquid cold storage medium adjusted to have the desired nature was supplied to a filling machine in which it was poured in a trunk member of an aluminum vessel of 250 ml by the amount of 220 ml, and, thereafter, liquefied nitrogen was fed from a supply nozzle therefor into the trunk member before the cover member was sealingly applied to the trunk member by a crimping operation, then the trunk member was supplied to a crimping machine so as to sealingly apply the cover member to the trunk member.

The amount of the liquefied nitrogen poured into the vessel was so controlled by adjusting the flow rate and the pouring time thereof that the internal pressure of the vessel after the cover member was sealingly applied to the trunk member was 2 Kg/cm$^2$.

Figure 6:
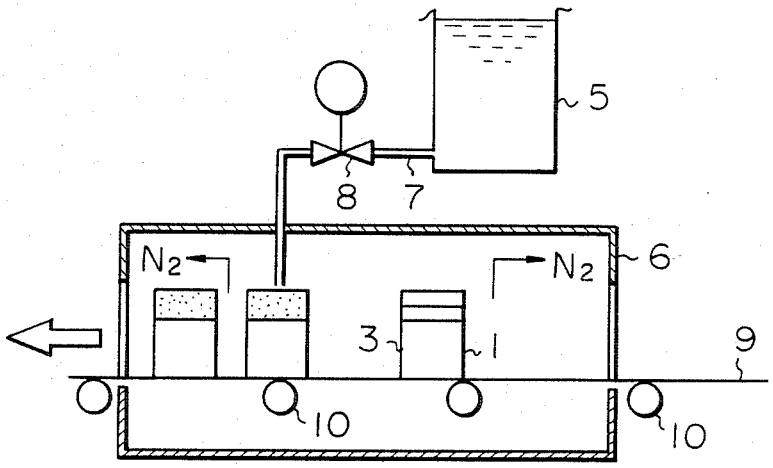
FIG. 6 is a schematic sectional view showing the process of compressively filling the vessel of FIG. 1 with an inert gas for producing the cold storage body of FIG. 1.

FIG. 6 shows the method of filling the vessel with the pressurized inert gas.

In FIG. 6, a tank 5 contains liquefied nitrogen. The liquefied nitrogen in the tank 5 is fed to a hermetically closed chamber 6 through a conduit 7 at a flow rate regulated by a solenoid valve 8 provided in the conduit 7 continuously or discontinuously. A conveyor belt 9 is passed through the chamber 6 over a plurality of guide rollers 10. The trunk members 1 each containing therein a predetermined amount of the cold storage medium 3 of a desired composition are continuously fed successively through the chamber 6 so that the liquefied nitrogen is poured into the respective trunk member 1 by an appropriate amount as regulated by the solenoid valve 8. The liquefied nitrogen poured into the trunk member 1 purges air present in the space 4 out of it as a portion of the liquefied nitrogen vaporizes. A cover member 2 is sealingly applied to the thus prepared trunk member 1 by a crimping machine during the time an appropriate amount of the liquefied nitrogen is still left in the space 4.

Thus, an appropriate pressure above the atmospheric is generated in the space 4 of the vessel, because the liquefied nitrogen left in the space 4 after application of the cover member 2 to the trunk member continues to vaporize so as to increase the internal pressure in the space 4 to about 2 $Kg/cm^2$, preferably to 1.85–2.15 atm.

It is clear that the aluminum vessel can be made from an extruded profiled hollow trunk member of aluminum or aluminum alloy to which a pair of cover members of aluminum or aluminum alloy are sealingly applied, the extruded trunk member being preferably provided with a plurality of reinforcing and cold transmitting property enhancing ridges and ribs in the inner and outer surfaces of the trunk member. All these modifications are to be considered to be within the scope of the present invention.

What is claimed is:

1. A method of making a cold storage body comprising the steps of:

providing a vessel consisting of a thin metallic material;

substantially filling said vessel with a liquid cold storage medium of low viscosity, so as to occupy most of the volume of said vessel;

removing air from said vessel and medium;

filling the remaining space with a vaporizable, liquified inert gas which is introduced into said vessel at a flow rate sufficient to increase the internal pressure in said remaining space to about 1.85 to about 2.15 atmospheres;

controlling the amount of vaporizable liquified inert gas by adjusting the flow rate and the pouring time to obtain an internal pressure in said vessel of 2 $Kg/cm^2$ after a cover member is sealingly applied to a trunk member which, together with said cover member, forms said vessel; and hermetically sealing said vessel.

2. The method of claim 1, wherein said gas is nitrogen, carbon dioxide or a mixture thereof.

3. The method of claim 1, wherein said metallic material is aluminum or an alloy thereof.

4. The method of claim 1, further including the step of applying a plastic coating on the inner surface of said vessel.

5. The method of claim 1, wherein said vessel is first filled with water as its base component liquid and additional components for regulating the melting point and viscosity of the water.

6. The method of claim 1, including filling of said vessel with liquified inert gas to at least 15% of the total volume of said vessel.

7. Cold storage body comprising:

a hermetically sealed vessel made from a thin sheet of aluminum alloy;

the inner space of said vessel having two portions, said first portion being filled mainly with a cold storage medium while the second portion is filled with pressurized nitrogen at a pressure of 1.82 to 2.15 atmospheres;

said cold storage medium comprising water as its base fluid to which additional components are added so as to regulate the melting point and the viscosity of said cold storage medium;

said vessel comprising a cylindrical trunk member with its one end closed and the other end opened; and a cover member with its peripheral edge curled or crimped with the peripheral edge of said open end of said cylindrical trunk member so as to achieve hermetic sealing of said vessel.

8. Cold storage body as set forth in claim 7, wherein said cover member has at least one recessed portion concentric with the center of said cover member for increasing the strength thereof and improving the cold transmitting property.

9. Cold storage body as set forth in claim 7, wherein said closed end of said cylindrical trunk member includes at least one portion provided with a recess concentric with the center of said closed end for increasing the strength thereof and improving the cold transmitting property.

10. Cold storage body as set forth in claim 7, including a plurality of parallel corrugations on the wall of said cylindrical trunk member for increasing the strength thereof and improving the cold transmitting property.

11. Cold storage body as claimed in claim 7, further including a crimp securing and crimping the peripheral edge of said cover member and the open end of said cylindrical trunk member in a sealed relation.

12. Cold storage body as claimed in claim 7, wherein the inner surface of said aluminum vessel is oxidized.

13. Cold storage body as claimed in claim 7, wherein the maximum diameter of said trunk member is 2 mm. and, said trunk member is provided with parallel ridges, thereby increasing the strength of the vessel and imparting rigidity thereto so that food can be refrigerated at a low temperature in the range of −15° C. to −25° C.

14. Cold storage body as set forth in claim 8, including a recessed portion concentric with and formed in the center of said closed end for increasing the strength thereof and improving its cold transmitting property.

15. Cold storage body as set forth in claim 8, including a plurality of parallel corrugations in the wall of said cylindrical trunk member for increasing the strength thereof and improving its cold transmitting property.

16. Cold storage body as set forth in claim 14, including a plurality of parallel corrugations in said trunk member for increasing the strength thereof and improving its cold transmitting property.

17. Cold storage body as claimed in claim 7, wherein the inner surface of said aluminum vessel is oxidized.

18. A cold storage body as set forth in claim 12, further including a plastic coating on said oxidized inner surface of said aluminum vessel.

* * * * *